US011618997B2

(12) United States Patent
Himstedt et al.

(10) Patent No.: US 11,618,997 B2
(45) Date of Patent: Apr. 4, 2023

(54) REINFORCED POLYMERIC NONWOVEN MAT FOR CARPET TILES

(71) Applicant: JOHNS MANVILLE, Denver, CO (US)

(72) Inventors: Heath H. Himstedt, Littleton, CO (US); Souvik Nandi, Highlands Ranch, CO (US); Philip Christopher Sharpe, Weddington, NC (US)

(73) Assignee: Johns Manville, Denver, CO (US)

( * ) Notice: Subject to any disclaimer, the term of this patent is extended or adjusted under 35 U.S.C. 154(b) by 8 days.

(21) Appl. No.: 17/085,060

(22) Filed: Oct. 30, 2020

(65) Prior Publication Data

US 2022/0136169 A1 May 5, 2022

(51) Int. Cl.
*D06N 7/00* (2006.01)

(52) U.S. Cl.
CPC ..... *D06N 7/0081* (2013.01); *D06N 7/0076* (2013.01); *D06N 7/0078* (2013.01); *D06N 7/0086* (2013.01); *D06N 2201/0254* (2013.01); *D06N 2201/082* (2013.01); *D06N 2209/1628* (2013.01); *D06N 2211/066* (2013.01); *Y10T 428/23979* (2015.04)

(58) Field of Classification Search
CPC ..... D06N 7/0081; D06N 7/0086; B32B 5/06; B32B 5/26; B32B 5/273; B32B 2471/02; D04H 1/593; D04H 1/58; D04H 3/12
See application file for complete search history.

(56) References Cited

U.S. PATENT DOCUMENTS 3,834,978 A * 9/1974 Nisenson ..... B32B 5/06 442/388
3,978,257 A * 8/1976 Ring ..... B32B 5/26 428/218
5,470,648 A * 11/1995 Pearlman ..... B32B 5/06 442/26
6,045,645 A 4/2000 Groh et al.
6,060,145 A * 5/2000 Smith ..... B32B 5/06 428/95
6,114,262 A 9/2000 Groh et al.
2005/0287334 A1* 12/2005 Wright ..... D06N 7/0081 428/95
2011/0244204 A1 10/2011 Migliavacca et al.

FOREIGN PATENT DOCUMENTS

EP 3 137 294 B1 11/2018

* cited by examiner

*Primary Examiner* — Larissa Rowe Emrich
(74) *Attorney, Agent, or Firm* — Robert D. Touslee

(57) ABSTRACT

A carpet tile includes a textile top member and a carrier mat that is coupled with the textile top member via a thermoplastic material. The textile top member includes carpet yarns and a backing that is coupled with the carpet yarns so that the backing structurally supports the carpet yarns. The carrier mat includes a polymeric material component, a reinforcement, and a binder that is uniformly distributed throughout the polymeric material component and reinforcement component. The polymeric material component includes polymer fibers that are randomly oriented and entangled together. The reinforcement is disposed within the polymeric material component so that the reinforcement is entirely covered and concealed by the entangled polymer fibers to prevent exposure to a user. The reinforcement mechanically reinforces and stabilizes the polymeric material component and carpet tile.

22 Claims, 4 Drawing Sheets

REINFORCED POLYMERIC NONWOVEN MAT FOR CARPET TILES

BACKGROUND OF THE INVENTION

Carpet tiles offer considerable advantages over rugs or wall to wall carpeting. For example, the use of carpet tiles for floor covering provides a simple installation process and allows removal of individual tiles which have become worn or soiled more than other tiles. Additionally, tiles may be rearranged or replaced to enhance decorative effects. Conventional carpet tiles include a pile fabric facing set into a layer of resilient thermoplastic (including elastomeric) material which is stiffened with a layer of suitable stiffening fibers, such as fiberglass fibers. The tile is generally backed with another layer of resilient elastomeric or thermoplastic material to which an adhesive may be applied to set the carpet tile onto the floor.

BRIEF SUMMARY OF THE INVENTION

The embodiments described herein provide a structurally reinforced impact-dampening component for carpet tile applications and other applications that utilize a reinforced backing or carrier. According to one aspect a carpet tile includes a textile top member, a carrier mat, and a binder. The textile top member includes carpet yarns and a backing that is coupled with the carpet yarns so that the backing structurally supports the carpet yarns. The carrier mat is coupled with the textile top member via a thermoplastic material. The carrier mat includes a polymeric material component having polymer fibers that are randomly oriented and entangled together. The carrier mat also includes a reinforcement that is disposed within the polymeric material component so that the reinforcement is entirely covered and concealed by the entangled polymer fibers to prevent the reinforcement from exposure to a user. The reinforcement includes a plurality of continuous strand high tenacity fibers that are configured to mechanically reinforce and stabilize the polymeric material component and carpet tile. The binder is uniformly distributed throughout the polymeric material component and the reinforcement component to bond the polymer fibers and continuous strand high tenacity fibers together in the carrier mat. The binder is the only binder that is used to bond the carrier mat together.

The carrier mat may have a thickness between 0.25 and 10 millimeters. The carrier mat may have a weight of between 50 and 1,000 grams per square meter (gsm). The polymer fibers of the polymeric material component may include polyesters, polyolefins, a combination of polyesters and polyolefins, and the like. The reinforcement may be a grid-pattern scrim that is made of high tenacity glass or polymer fibers that are oriented in a machine direction and a cross-machine direction. The carrier mat may include between 5 and 30 weight percent of the binder. The reinforcement may be non-centered, or of centered, within the polymeric material component so that the reinforcement is positioned closer to an upper surface of the polymeric material component than a lower surface of the polymeric material component. In such embodiments, the reinforcement may be positioned within the polymeric material component so that at least 60% of the polymeric material of the polymeric material component is positioned below the reinforcement and at least 5% of the polymeric material of the polymeric material component is positioned above the reinforcement.

The reinforcement may be between 0.5 and 50 weight percent of the carrier mat. The continuous strand high tenacity fibers may exhibit a maximum load of at least 3 lbf/in and a maximum elongation of 65% when measured according to ASTM D4830. The binder may be a formaldehyde free binder. In such embodiments, the formaldehyde free binder may be a thermoplastic material binder. In such embodiments, the continuous strand high tenacity fibers may consist of polymer fibers such that the carrier mat is made entirely or recyclable materials. The polymer fibers may be mechanically needled together to mechanically secure the polymeric material component and the reinforcement together. The thermoplastic material may penetrate through the polymeric material component to couple the carrier mat with the textile top member.

According to another aspect, a carpet tile may include a textile top member, a carrier mat, and a binder. The textile top member may include carpet yarns and a backing that is coupled with the carpet yarns so that the backing structurally supports the carpet yarns. The carrier mat may be coupled with the textile top member via a thermoplastic material. The carrier mat may include a polymeric material component having polymer fibers that are randomly oriented and entangled together and a reinforcement that is disposed within the polymeric material component so that the reinforcement is entirely covered and concealed by the entangled polymer fibers to prevent the reinforcement from exposure to a user. The reinforcement may be configured to mechanically reinforce and stabilize the polymeric material component and carpet tile. The binder may be uniformly distributed throughout the polymeric material component and reinforcement component.

The reinforcement may be a scrim, threads, nonwoven mat, chopped strand mat, and the like. The reinforcement may consist of continuous strand high tenacity fibers. The binder may be a formaldehyde free binder. The formaldehyde free binder may consist of a thermoplastic material. The carrier mat may have a thickness between 1 and 8 millimeters. The carrier mat may also have a weight of between 250 and 1,000 grams per square meter (gsm).

According to another aspect, a method of manufacturing a carrier mat for carpet tiles includes forming a first layer of polymer fibers that are randomly oriented and entangled together and positioning a reinforcement atop the first layer of polymer fibers. The method also includes forming a second layer of polymer fibers atop the reinforcement so that the reinforcement is entirely covered and concealed by the first layer of polymer fibers and the second layer of polymer fibers and applying a binder to the first layer of polymer fibers, the reinforcement, and the second layer of polymer fibers. The method further includes heating the first layer of polymer fibers, the reinforcement, and the second layer of polymer fibers to cure the binder to adhere the first layer of polymer fibers, the reinforcement, and the second layer of polymer fibers together.

In some embodiments, the reinforcement is non-centered within the polymeric material component so that the reinforcement is positioned closer to a top surface of the polymeric material component than a bottom surface of the polymeric material component. In such embodiments, the reinforcement may be positioned within the polymeric material component so that at least 60% of the polymeric material of the polymeric material component is positioned below the reinforcement and at least 5% of the polymeric material of the polymeric material component is positioned above the reinforcement. The carrier mat may have a thickness between 1 and 8 millimeters and/or a weight of between 250 and 1,000 grams per square meter (gsm). The polymer fibers of the polymeric material component may be mechanically needled together to mechanically secure the polymeric material component and the reinforcement.

According to yet another embodiment, a method of forming a carpet tile includes providing a carrier mat as described herein and coupling the carrier mat to a textile top member via an adhesive material. As described herein, the textile top member includes carpet yarns and a backing coupled with the carpet yarns. The adhesive material may penetrate into the entangled polymer fibers of the polymeric material component. The adhesive material may include or consists of a thermoplastic material or a plastisol.

BRIEF DESCRIPTION OF THE DRAWINGS

Various features, aspects, and advantages of the present invention will be better understood when the following detailed description is read with reference to the accompanying figures in which like characters represent like parts throughout the figures, wherein.

DETAILED DESCRIPTION OF THE INVENTION

Figure 1:
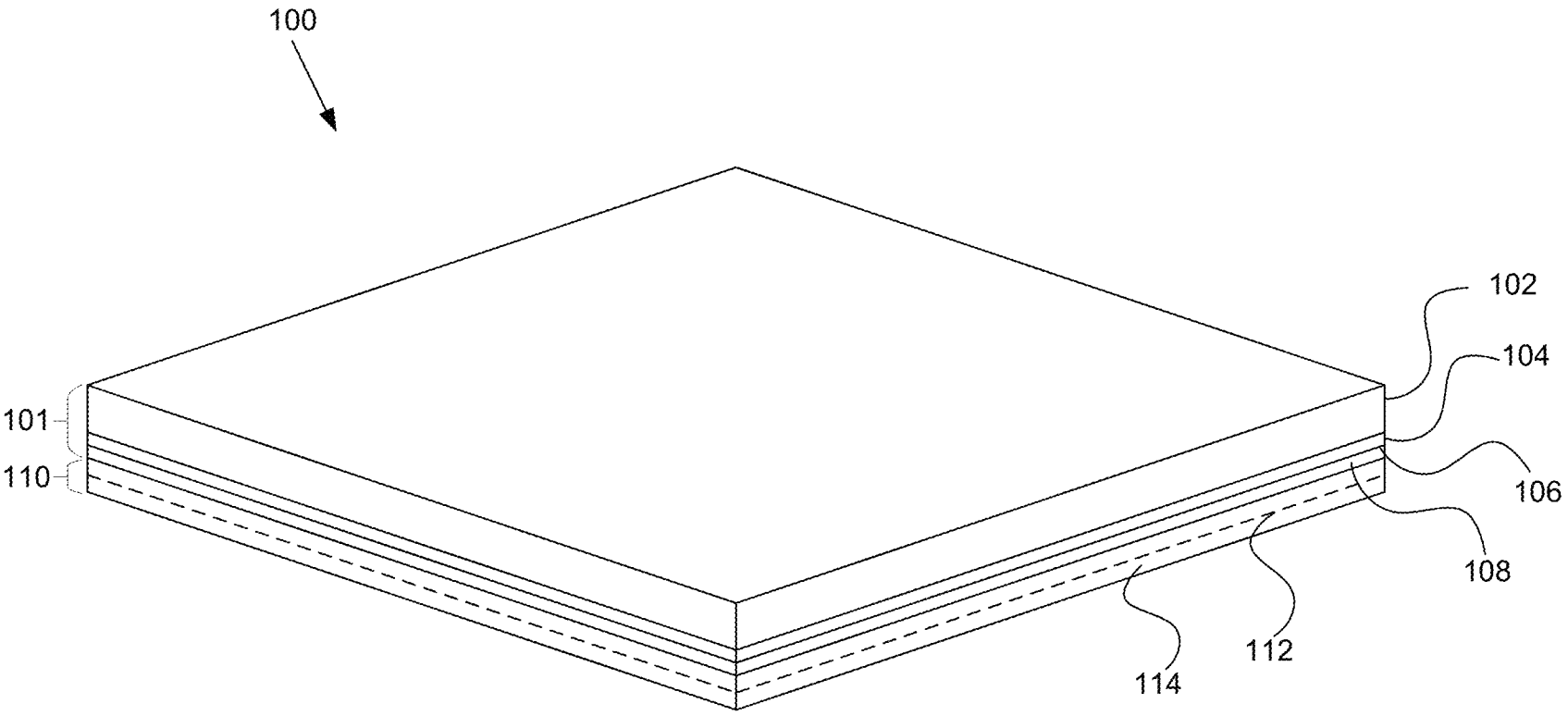
FIG. 1 is an isometric view of a carpet tile according to embodiments.

The ensuing description provides exemplary embodiments only, and is not intended to limit the scope, applicability, or configuration of the disclosure. Rather, the ensuing description of the exemplary embodiments will provide those skilled in the art with an enabling description for implementing one or more exemplary embodiments. It being understood that various changes may be made in the function and arrangement of elements without departing from the spirit and scope of the invention as set forth in the appended claims.

The embodiments described herein are directed to reinforced polymeric nonwoven mat that are used in carpet tile applications as a backing or carrier layer. The polymeric nonwoven mat may be reinforced with glass and/or synthetic materials, such as yarns. Carpet tile panels are constructed in multiple layers typically consisting of carpet yarns, various backing layers, and thermoplastic compounds. Higher-end cushioned carpet tiles may use glass nonwoven mats for strength and rigidity along with a cap layer of thermoplastic or other material to encapsulate the glass nonwoven. The reinforced polymeric nonwoven provides the mechanical strength and stability that is commonly provided by the glass nonwoven and also provides a comfort under foot and surface feel of the cap layer.

In addition to the inclusion of the reinforcement material in the polymeric nonwoven mat, the polymeric nonwoven mat also includes a binder. The binder may be a chemical, non-fibrous binder, which is typically made of a thermoplastic or thermoset material. In some embodiments, the polymeric nonwoven mat may not include a binder. In such instances, the polymeric nonwoven mat may be coupled together via a low-melt fiber, an adhesive web, or mechanical entangling of the fibers. The addition of the binder enhances the strength and stability of the polymeric nonwoven mat. It has been determined that the inclusion of the reinforcement material and binder in the polymeric nonwoven mat yields dimensional stability improvements that are greater than anticipated. Specifically, when compared to the dimensional stability improvement that is exhibited when a reinforcement material or binder are used in isolation, the combination of the reinforcement material and binder in tandem has a synergistic effect that dramatically improves carpet tile performance. The synergistic effects of the combination of the reinforcement material and binder may allow a reduced amount of thermoplastic compound to be used in the finished carpet tile while still maintaining a desired dimensional stability.

The reinforced polymeric nonwoven mat typically has a thickness between 0.25 and 10 millimeters and a weight of between 50 and 1,000 grams per square meter (gsm), and more commonly between 250 and 1,000 gsm. This polymeric nonwoven mat could be produced with a variety of polymers, and is most commonly produced with polyester fibers, polyolefin fibers, or a combination of the two fibers. The reinforcement material is commonly introduced into the polymeric nonwoven mat during production for increased strength and stability. As such, the reinforcement material is integrated into the polymeric nonwoven mat in a manner that results in the two materials functioning as a single layer material. The reinforcement material is often a grid-pattern scrim made of high tenacity glass or polymer fibers. The threads of the scrim may be joined to other threads via thermal, chemical, or mechanical bonding to create an integral reinforcement mat. Typically an adhesive is applied to points of contact between different threads to bond the scrim together. The high tenacity glass or polymer fibers may be chopped fibers or continuous strand fibers. Continuous strand fibers may be preferred due to their increased ability to resist stretching or elongation. The high tenacity glass or polymer continuous strand fibers are commonly oriented in both a machine direction and a cross-machine direction.

In other embodiments, high tenacity glass or polymer continuous threads that are oriented in a single direction could be used. In yet other embodiments, a nonwoven fiber mat or chopped strand mat may be used as the reinforcement material. The nonwoven fiber mat or chopped strand mat may include or consist of high tenacity glass or polymer fibers. The reinforcement material may include a combination of a scrim, unilateral thread, nonwoven mat, or chopped strand mat, although the reinforcement material is more commonly made from only one of these materials.

The term "high tenacity" fibers as used herein refers to fibers having a maximum load of at least 3 lbf/in and a maximum elongation of 65% when measured according to ASTM D4830. More preferably the maximum load is at least about 6 lbf/in and the elongation less than 15%. The use of high tenacity fibers results in less elongation of the reinforcement. It is believed that lower elongation in the reinforcement contributes to greater dimensional stability of the polymeric nonwoven mat and carpet tile.

The term "continuous strand" fibers as used herein refers to fibers having a length to diameter ratio of greater than 10,0000. Continuous strands may resist elongation, stretching, or deformation, which may provide the polymeric nonwoven mat and carpet tile with increased dimensional stability. The fiber threads may be formed from a single fiber strand or woven from multiple individual fiber strands. The fiber strands and/or threads may be composed or consist of glass fibers or polymer fibers. The fiber strands and/or threads are most preferably composed of glass fibers, polyolefin fibers, or polyester fibers.

The reinforcement typically makes up between 0.5% and 50% of the finished mat by weight measured according to ASTM D3776. The reinforcement may be placed at varying heights within the polymeric nonwoven mat. When processed into a carpet or carpet tile the location of the reinforcement may yield certain advantageous properties. In general the reinforcement is placed in the middle of the polymeric nonwoven mat so that there is equal weight of polymer fibers above and below the reinforcement. In some embodiments, however, the reinforcement is positioned toward an upper surface of the polymeric nonwoven mat to tailor the strength, dimensional stability, processing, and/or performance of the finished carpet tile.

The binder typically has a very low or negligible amount of formaldehyde. The binder may be referred to herein as a formaldehyde-free binder. The term formaldehyde-free binder as used herein refers to binders that have a formaldehyde that measures less than 9 ug/m$^3$ when measured according to UL 2818, which is also known as the California Department of Public Health (CDPH) Specification 01350. Preferably the formaldehyde is sufficiently low that the polymeric nonwoven mat alone is able to measure less than 5 ug/m$^3$ and more preferably less than 2 ug/m$^3$. In some instance, the binder includes no formaldehyde or functionally no formaldehyde so that the detection limit of 0.5 ug/m$^3$ is not reached. Stated differently, the binder has a formaldehyde content that measures less than 0.5 ug/m$^3$ or includes no formaldehyde content at all.

The amount of binder within the polymeric nonwoven mat may vary based on the desired weight of the finished polymeric nonwoven mat, the solids concentration in the applied binder, and/or the application of the binder to the nonwoven mat. In general, the polymeric nonwoven mat has a binder content of between 5 and 30 weight percent. This amount of binder can be tailored to achieve a desired mat thickness, weight and/or dimensional stability.

The polymeric nonwoven mat replaces various layers in conventional carpet backers. In addition to replacing various layers in conventional carpet backers, the polymeric nonwoven mat may also provide an acoustic and moisture barrier layer, which is an unexpected result. For example, early indications suggest that a mat with both a scrim and binder may have an unexpected improvement to sound dampening when measured in accordance with ASTM E2611 and E1050. Depending on the frequency of sound, mats with both scrim and binder showed a 10-30% improvement in sound dampening compared to a bindered mat with no scrim. It was unexpected that the scrim contributed to sound dampening given its lightweight, open structure, and low percentage of the mat thickness. While mat weight/thickness will primarily be the primary factor in how well a mat dampens sound, the presence of both scrim and a binder at a given thickness demonstrated an unexpected improvement in this metric.

The addition of binder is known to drastically alter the hydrophobicity or hydrophilicity of a nonwoven. Thus, the water barrier performance of a nonwoven can be tailored by choosing an appropriate binder amount and chemistry. An embedded scrim in the nonwoven does not affect the surface barrier properties; however, it may help dissipate water which does manage to soak into the backing. Better water dissipation would help minimize blistering and/or discoloration.

In some embodiments, the polymeric nonwoven mat (hereinafter carrier mat) has a weight of more than 250 grams per square meter. In some embodiments, the carrier mat may have a thickness of at least 1 mm and preferably at least 2 mm. The carrier mat may also have a density of less than 15 lb/ft$^3$. The thickness and density of the carrier mat may give the carrier mat a high capacity for absorption of any coatings or additives the carpet tile producer may use. In some embodiments, the carrier mat has a thickness between 2 and 6 millimeters and/or a weight of between 400 and 800 gsm. In yet another embodiment, the carrier mat has a thickness between 3 and 5 millimeters and a weight of between 500 and 650 gsm.

In an exemplary embodiment, the carrier mat consists of polyester fibers. Polyester fibers are comfortable to handle and are bendable and able to recover from a bent state. The term "bendable" as used herein refers to materials that are not brittle. For example, the bendable fibers may be contorted, bent, wrapped, compressed, or in similar manners stressed without breaking. Stated differently, the bendable fibers do not break under normal roll handling and processing during carpet tile manufacturing and future use of the carpet tile. The terms "recoverable" or "spongy" as used herein refer to materials that are able to be compressed under weight without permanently deforming, such as a material that returns to its original thickness once a weight or compression is removed. The carrier mat should be able to withstand at least 15 pounds per square inch (psi) and compress less than 10% of its thickness at 15 psi. The resistance to compression allows the layer to have a spring or elastic like quality, which enables the carrier mat to recover or return to an original volume after repeated compression.

In addition to the use of the binder, the polymer fibers of the carrier mat may be mechanically bonded using techniques such as needling, which increases the physical entanglement of the polymer fibers. The bonded polymer fibers, and in some instances the needled polymer fibers, results in a carrier mat that is relatively porous and open. As such, during bonding or coupling of the carrier mat with the carpet tile, the thermoplastic material that bonds the carrier mat and carpet tile is able to penetrate into the carrier mat. As such, subsequent to bonding, the carrier mat includes some adhesive material (i.e., the thermoplastic material) that bonds the carpet tile and carrier mat. In some instances, the thermoplastic material may not penetrate through an entire thickness of the carrier mat. In such instances, a bottom portion of the carrier mat may remain free of any adhesive. For example, the portion of the carrier mat that is below the reinforcement may remain entirely free of the thermoplastic material. In such embodiments, the reinforcement may function as a filter to prevent penetration of the thermoplastic material into the carrier mat below the reinforcement. In other embodiments, the thermoplastic material may penetrate through the entire thickness of the carrier mat so that the carrier mat is entirely saturated with the thermoplastic material.

As described herein, the reinforcement is disposed within the carrier mat so that the reinforcement is entirely covered and concealed by the intermeshed polymer fibers of the carrier mat. The polymeric material component and the reinforcement form a unitary or consolidated material since the two materials are integrally formed together. In contrast, conventional carpet tiles include separate layers that are bonded or adhered with the use of an adhesive or binder layer between the various layers. This results in a stratum of layers of adhesive and materials. In contract, the binder that is used to couple or bond the carrier mat described herein is homogenously dispersed within the carrier mat and through the reinforcement and polymeric material component, which results in the carrier mat functioning like a single or unitary product.

The covering and concealing of the reinforcement by the intermeshed polymer fibers prevents the reinforcement from being exposed to the surrounding environment and to a user that is handling or installing the carpet tile. Since the reinforcement is entirely covered and concealed by the polymer fibers, the carrier mat is suitable for handling during installation of the carpet tile. In contrast, conventional carpet tile typically employ multiple thermoplastic layers or films that are required to coat and encapsulate a fiberglass backing. These thermoplastic layers or films are required to ensure that the fiberglass backing does not contact a user during handling or installation of the carpet tile. The instant carpet tile does not require the use of the thermoplastic layers or films since the reinforcement is entirely contained within the carrier mat.

Having described various embodiments generally, additional aspects and features of the carpet tile and backing or carrier will be more evident with reference to the description of the various drawings provided herein below.

Figure 2:
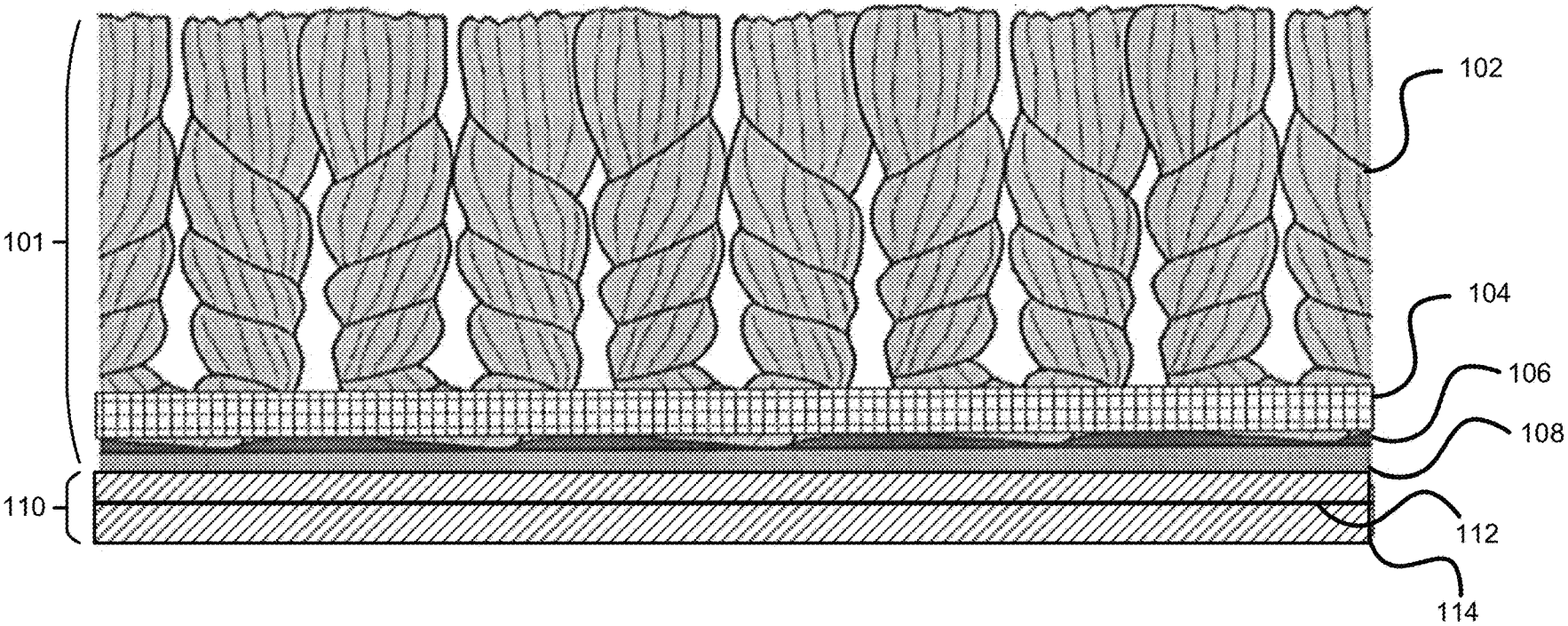
FIG. 2 is a detailed side view of the carpet tile of FIG. 1.

FIGS. 1 and 2 illustrate an embodiment of a carpet tile 100. The carpet tile 100 is shown as being square-shaped, which is a common shape of carpet tiles. However, as a person of skill in the art will readily recognize, the carpet tile 100 may be cut or otherwise formed in any desired shape and/or can be sized to match any desired application. Additionally, the textile top member may be formed from any fabric or other textile material to fit the needs or aesthetics of a particular application. Carpet tile 100 includes a textile top member 101 that is positioned atop a carrier mat 110.

The textile top member includes carpet yarns 102 that are attached to a backing 104. The carpet yarns 102 may be formed from any fabric or other textile material to fit the needs or aesthetics of a particular application, and may specifically include tufted carpet yarns, pile fabric yarns, polyester fibers, nylon fibers, polyolefin fibers, and the like. The carpet yarns 102, such as a pile fabric layer or other fabric layer, serves as an exposed top surface of the carpet tile. The carpet yarns 102 are typically hooked through the backing 104 and secured or coupled to the back of the backing 104. Coupling the carpet yarns 102 to the backing 104 typically involves using various adhesives, such as hot melt materials. The backing 104 is typically a woven or nonwoven material that is often made of polymer, cellulose fibers, or a combination of these. The backing 104 structurally supports and reinforces the textile top member 101. A pre-coat 106 is typically positioned on the backing 104 to lock the carpet yarns 102 in place. The pre-coat may be a latex based material or any other suitable material. In some instances, the pre-coat may be a hot melt adhesive that may be designed to permit lamination between the textile top member 101 and the carrier mat 110. The textile top member 101 and/or carpet tile 100 may include additional materials, such as flame retardants and the like, depending on the end use of the carpet tile 100.

The carrier mat 110 is attached to the textile top member 101 via a thermoplastic material 108, such as a thermoplastic elastomer and/or a plastisol material. Exemplary thermoplastic materials 108 that may be used to couple the carrier mat 110 with the textile top member 101 include polymers or copolymers of latex, vinyl chlorides, polyolefins, polyurethanes, acrylates, acrylics, or styrenes. The thermoplastic material 108 typically adheres to the precoat layer 106 and penetrates into the carrier mat 110. The amount or degree of penetration of the thermoplastic material 108 into the carrier mat 110, may be controlled as described below. The carrier mat 110 is designed to provide impact dampening for the carpet tile 100. The carrier mat 110 is also strong enough to contribute to the structural integrity of the finished carpet tile 100 in the same manner as conventional backings.

The carrier mat 110 is a multi-function unitary or consolidated material that provides the above described reinforcement and structural features. The consolidated carrier mat 110 replaces multiple layers in conventional carpet tiles, such as a separate cushioning mat, secondary backing, and thermoplastic coating layer. The secondary backing material that is used in conventional carpet tiles is typically a glass nonwoven. The secondary backing material is a required layer that provides dimensional stability to the carpet tile. The secondary backing is coated with a thermoplastic coating so that the glass fibers are not exposed to a user, which may cause irritation and/or itch. The thermoplastic coating is typically applied as a coating to the top and bottom of the secondary backing to ensure that the thermoplastic material fully surrounds and encapsulate the glass fibers. The thermoplastic coating is also used to attach the secondary backing to the carrier mat so that the secondary backing forms a separate layer atop the carrier mat. The carrier mat can be either a foamed polymeric material, such as polyurethane or a felt material. The carrier mat may contain additional additives, such as fire retardants and the like.

In contrast to these various layers, the carrier mat 110 described herein is a unitary or consolidated material that is able to provide both impact dampening and structural strength. The term unitary or consolidated means that the components of the carrier mat 110 are formed in a manner that results in the carrier mat 110 functioning as a single material. The impact dampening is provided by a polymeric material component 114 that includes polymer fibers that are randomly oriented and entangled together. The polymeric material component 114 is typically a spunbond material that is lofty and recoverable, meaning that the material is an elastically compressible material that is able to rebound or recover from a compressed state. The polymer fibers of the polymeric material component 114 may comprise or consist of polyesters, polyolefins, or a combination of polyesters and polyolefins.

The structural strength is provided by a reinforcement 112 that is disposed within the polymeric material component 114 so that the reinforcement 112 is entirely covered and concealed by the intermeshed or entangled polymer fibers. The reinforcement 112 mechanically reinforces and stabilizes the polymeric material component 114 and carpet tile 100. Positioning the reinforcement 112 within the polymeric material component 114 prevents the reinforcement 112 from being exposed to the surrounding environment, and in particular to a user that may be handling or installing the carrier mat 110 or carpet tile 100.

The reinforcement 112 may be a scrim, threads (e.g., unilaterally oriented threads), a nonwoven mat, and/or a chopped strand mat. In some embodiments, the reinforcement 112 consists of high tenacity fibers or threads and more commonly continuous strand high tenacity fibers or threads. In a specific embodiment, the reinforcement 112 includes a plurality of continuous strand high tenacity fibers. In such embodiments, the reinforcement 112 may be a grid-pattern scrim that is made of high tenacity glass or polymer fibers that are oriented in a machine direction and a cross-machine direction. The reinforcement 112 may be between 0.5 and 50 weight percent of the carrier mat. The continuous strand high tenacity fibers may exhibit a maximum load of at least 3 lbf/in and a maximum elongation of 65% when measured according to ASTM D4830.

The carrier mat 110 typically has a thickness between 0.25 and 10 millimeters and more commonly between 1 and 8 millimeters. In a specific embodiment, the carrier mat 110 has a thickness of between 2 and 6 millimeters. In yet another specific embodiment, the carrier mat 110 has a thickness of between 3 and 5 millimeters.

The density of the carrier mat 110 may vary depending on the end application of the carpet tile 100. For example, the carrier mat 110 may be constructed to be relatively thin and dense or thick and open. The former construction may allow the carrier mat 110 to hold its shape better and may be suited for high use or traffic areas while the latter construction may be preferred for increased cushioning and comfort due to its loftier design. The carrier mat 110 typically has a weight of between 50 and 1,000 grams per square meter (gsm), more commonly between 250 and 1,000 gsm, and most commonly between 400 and 800 gsm. In s specific embodiment, the carrier mat 110 has a weight of between 500 and 650 gsm.

A binder is used to adhere or bond the polymer fibers of the polymeric material component 114 together. The binder is homogenously or uniformly distributed throughout the carrier mat 110. For example, the binder is homogenously or uniformly distributed or dispersed through the intermeshed or entangled polymer fibers and the reinforcement 112. The binder bonds the intermeshed or entangled polymer fibers together and bonds the reinforcement 112 to the intermeshed or entangled polymer fibers. As provided herein, the use of the binder and the reinforcement greatly increases a dimensional stability of the carrier mat 110. The dimensional stability improvement that is exhibited due to the use of the binder and reinforcement 112 is greater than a dimensional stability that is achieved when the reinforcement 112 or binder are used in isolation and is also greater than what would be anticipated by combining the dimensional stability exhibited by each material in isolation. The combination of the reinforcement 112 and binder has a synergistic effect that dramatically improves the dimensional stability and carpet tile 100 performance.

The binder is typically a formaldehyde free binder and commonly includes or consists of a thermoplastic or thermoset material. In an exemplary embodiment, the binder may consist of a thermoplastic material. The formaldehyde free binder may be the only binder that is used to bond the carrier mat 110 together. Stated differently, the carrier mat 110 may not include any binder other than the formaldehyde free binder and the formaldehyde free binder may not be concentrated in any one area within the carrier mat 110. The polymer fibers of the carrier mat 110 may be also mechanically bonded (e.g., needled) in addition to using the binder. The mechanically bonded polymer fibers may also entangle with and mechanically bond the polymer fibers to the reinforcement 112. The carrier mat 110 may include between 5 and 30 weight percent of the formaldehyde free binder.

As briefly described above, the carrier mat 110 is relatively porous or has a degree of openness that allows the carrier mat 110 to absorb a thermoplastic compound or material 108 that is used to bond or adhere the carrier mat 110 to the textile top member 101. Since the thermoplastic material 108 absorbs into the carrier mat 110 to a degree, the carrier mat 110 will include some amount of the thermoplastic material 108 after the carrier mat 110 is attached to the textile top member 101.

In some embodiments, the thermoplastic material 108 may absorb into the carrier mat 110 and may fully surround and encapsulate the reinforcement 112 that is disposed within the carrier mat. In such embodiments, the reinforcement 112 may be both positioned within the carrier mat 110 and fully encapsulated and covered by the thermoplastic material 108. The full encapsulation of the reinforcement 112 by the thermoplastic material may aid in reinforcing the carpet tile. In such embodiments, the thermoplastic material 108 may penetrate through an entire thickness of the carrier mat 110 so that the carrier mat 110 is entirely saturated with the thermoplastic material 108 and the thermoplastic material extends from an upper surface to a lower surface of the carrier mat 110. In other embodiments, the thermoplastic material 108 may partially penetrated into the carrier mat 110 so that the thermoplastic material 108 does not extend to a lower surface of the carrier mat 110. For example, the thermoplastic material 108 may not penetrate into the carrier mat 110 below the reinforcement 112 and thus, a portion or volume of the polymeric material component 114 that is below the reinforcement 112 may remain free of the thermoplastic material 108.

In some embodiments, the polymer fibers of the polymeric material component 114 comprise or consist of polymer fibers having an average fiber diameter of between 0.5 and 10 denier, and more commonly comprise or consist of polymer fibers having an average fiber diameter of between 1 and 10 denier. In more specific embodiments, the polymer fibers comprise or consist of polymer fibers having an average fiber diameter of between 2.5 and 9 denier and most commonly comprise or consist of polymer fibers having an average fiber diameter of between 4 and 9 denier. The larger fiber diameters typically yield stronger fibers that are more resistant to compression and able to handle more weight and/or recover better to compression events. Polymer fibers, and in particular polyester fibers, demonstrate good abilities in resisting compression and handling weight.

In some embodiments, the reinforcement 112 comprises or consists of glass fibers having an average fiber diameter between about 10 and 90 tex and more commonly comprises or consists of glass fibers having an average fiber diameter between about 10 and 50 tex or between 50 and 90 tex. In a specific embodiment, the reinforcement 112 comprises or consists of glass fibers having an average fiber diameter between about 30 and 36 tex or between 65 and 71 tex. Thicker glass fibers typically result in greater tensile strength and may be employed when stronger scrim reinforcement materials are required.

Figure 3:
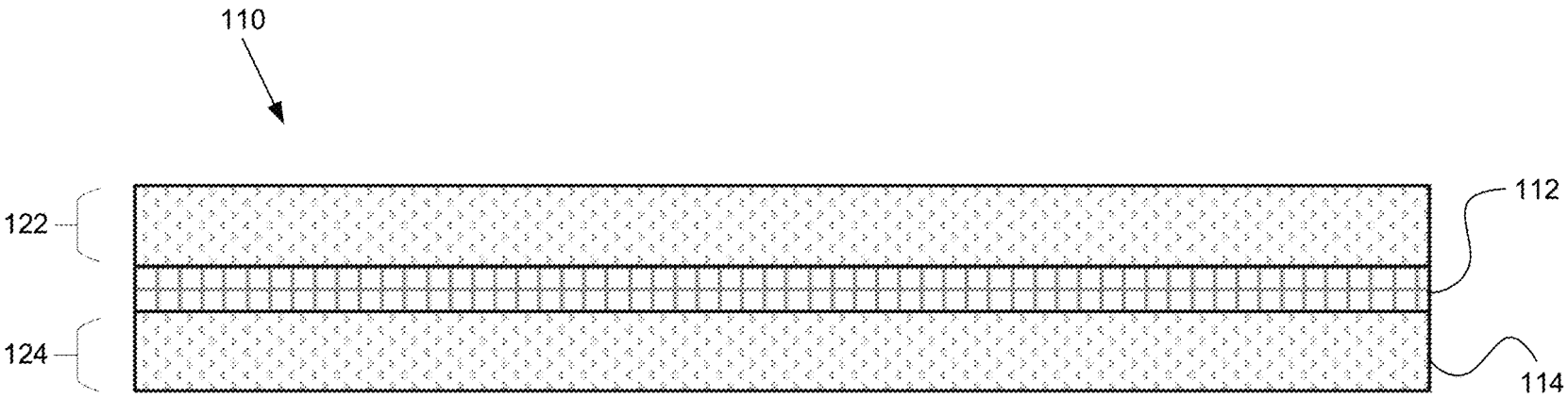
FIGS. 3 & 4 illustrate embodiments of a carrier mat of the carpet tile of FIG. 1 in greater detail.
Figure 4:
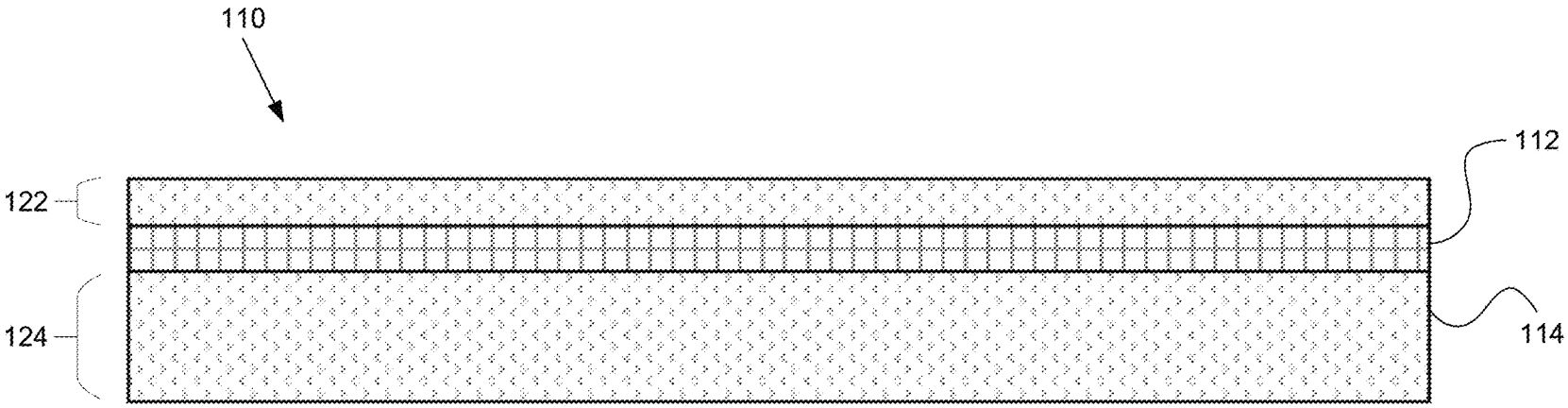

Referring now to FIGS. 3 and 4, embodiments of the carrier mat 110 are illustrated in greater detail. Specifically, FIGS. 3 and 4 illustrate how the position of the reinforcement 112 within the polymeric material component 114 may be adjusted to achieve a desired effect in the carpet tile 100. In FIG. 3, the reinforcement 112 is roughly centered within the polymeric material component 114 so that a first portion or volume 122 of polymer fibers that is positioned above the reinforcement 112 is roughly equal to a second portion or volume 124 of polymer fibers that is positioned below the reinforcement 112. The centered configuration of the reinforcement 112 may be desired when increased bonding between the carrier mat 110 and textile top member 101 is desired. For example, when the thermoplastic material 108 penetrates into the carrier mat 110 up to the reinforcement 112, but not beyond the reinforcement, the center positioning of the reinforcement 112 allows additional thermoplastic material 108 to absorb into the carrier mat 110, which increases the bond between the carrier mat 110 and the textile top member 101. The increased penetration of the thermoplastic material 108 into the carrier mat 110 may render the carrier mat 110 more rigid and more resistant to wear. Thus, the center positioning of the reinforcement 112 may be preferred when the carpet tile 100 is used in high traffic areas. In addition, the center positioning of the reinforcement 112 allows either side of the carrier mat 110 to function as a top surface. The non-centered positioned of the reinforcement 112 may be preferred in areas where increased comfort is desired.

In contrast, in FIG. 4, the reinforcement 112 is non-centered within the polymeric material component 114 so that the scrim reinforcement is positioned closer to a top surface of the polymeric material component 114 than a bottom surface of the polymeric material component 114. Since the reinforcement 112 is not centered within the polymeric material component 114, the first portion or volume 122 of polymer fibers that is positioned above the reinforcement 112 is less than the second portion or volume 124 of polymer fibers that is positioned below the reinforcement 112. The non-centered reinforcement 112 may be preferred when increased dampening is preferred. For example, the dampening effect of the carrier mat 110 may be provided mainly from the second portion or volume 124 of polymer fibers. Since the second portion or volume 124 of polymer fibers is greater when the reinforcement 112 is not centered, the dampening properties of the carrier mat 110 may be enhanced. In addition, when the thermoplastic material 108 does not penetrate into the polymeric material component 114 below the reinforcement 112, the second portion or volume 124 of polymer fibers are not constrained or restricted in their movement and response by the thermoplastic material 108. As such, the polymer fibers in the second portion or volume 124 may be more responsive as the carrier mat is compressed, which may enhance the desired dampening properties of the carrier mat 110.

In some embodiments, the reinforcement 112 is positioned within the polymeric material component 114 so that at least 65% or 70% of the polymer fibers are positioned below the reinforcement 112 and at least 5% of the polymer fibers are positioned above the reinforcement 112. Stated differently, the reinforcement 112 may be positioned within the polymeric material component 114 so that the second portion or volume 124 is at least 65% or 70% of the volume of the carrier mat 110 and the first portion or volume 122 is at least 5% of the volume of the carrier mat 110. In other embodiments, the reinforcement 112 is positioned within the polymeric material component 114 so that at least 60-95% of the polymer fibers are positioned below the reinforcement 112 and so that at least 5-40% of the polymer fibers are positioned above the reinforcement 112. In a more specific embodiment, the reinforcement 112 is positioned within the polymeric material component 114 so that at least 65-90% of the polymer fibers are positioned below the reinforcement 112 and so that at least 10-35% of the polymer fibers are positioned above the reinforcement 112. In yet another specific embodiment, the reinforcement 112 is positioned within the polymeric material component 114 so that at least 65-75% of the polymer fibers are positioned below the reinforcement 112 and so that at least 25-35% of the polymer fibers are positioned above the reinforcement 112.

The reinforcement 112 may be positioned within the polymeric material component 114 during formation of the polymeric material component 114. Stated differently, incorporation of the reinforcement 112 into the polymeric material component 114 may be achieved in a single step or process so that the individual materials are not separately formed and then combined in a later stage or process (i.e., separately made and then bonded together). Rather, the materials may be formed simultaneously, which results in a carrier mat 110 that functions and behaves as a unitary or single component in terms of structure and integrity despite having different fiber compositions and/or materials. To form the materials simultaneously, the second portion or volume 124 may be formed, via spunbonding or another process, and the reinforcement 112 may be laid atop the second portion or volume 124 while the first portion or volume 122 is being formed, via spunbonding or another process. The various materials may then be mechanically bonded, such as via needling to make the carrier mat 110 function and behave as a single or unitary product. In some instances, the various materials may not be mechanically bonded. A binder may then be applied atop the first portion or volume 122, the reinforcement 112, and the second portion or volume 124. The binder may penetrate through all the material and may be cured to bond the first portion or volume 122, the reinforcement 112, and the second portion or volume 124 together.

As described herein, the thermoplastic material 108 can penetrate into the polymeric material component 114 to couple the carrier mat 110 to the textile top member 101. The thermoplastic material 108 is able to penetrate into the polymeric material component 114 due to a permeability of the polymeric material component 114. In contrast, in conventional carpet tile the adhesive material typically rests atop a secondary backing or only penetrates a negligible amount into the materials. The adhesive material typically coats the materials or penetrates into the materials just enough to adhere the two materials. The penetration of the thermoplastic material 108 into the polymeric material component 114 in the instant embodiments may enhance the bonding between the carrier mat 110 and the textile top member 101.

In some embodiments, the reinforcement 112 may control penetration of the thermoplastic material 108 into the polymeric material component 114 so that the thermoplastic material 108 is able to penetrate into the polymeric material component 114 up to the reinforcement 112, but not beyond the reinforcement 112. Limiting the penetration of the thermoplastic material 108 into the polymeric material component 114 may enable a desired dampening effect to be achieved. The depth or degree of penetration of the thermoplastic material 108 into the carrier mat 110 may be controlled by varying the position of the reinforcement 112 within the polymeric material component 114.

In other embodiments, the thermoplastic material 108 may penetrate entirely through the carrier mat 110 so that the entire carrier mat 110, and all the materials disposed therein, are impregnated or saturated with the thermoplastic material 108. In such embodiments, the reinforcement 112 may be open enough (e.g., have sufficient thread or fiber spacing) to allow the thermoplastic material 108 to penetrate through the reinforcement 112 and to the materials positioned below the reinforcement 112. In some instances it may be beneficial to ensure that the thermoplastic material 108 fully impregnates or saturates the carrier mat 110 and all the materials disposed therein.

Figure 5:
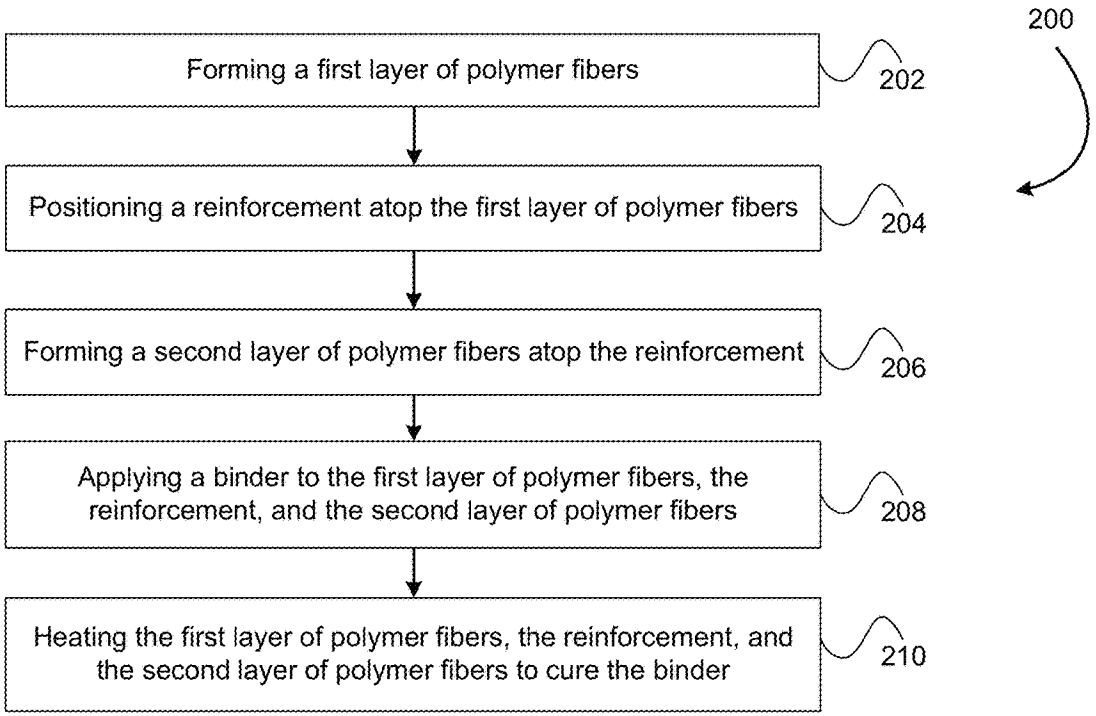
FIG. 5 illustrates a method of manufacturing a carrier mat for carpet tiles.

Referring now to FIG. 5, illustrated is a method 200 of manufacturing a carrier mat for carpet tiles. At block 202, a first layer of polymer fibers is formed. The polymer fibers are typically randomly oriented and entangled together in the first layer. At block 204, a reinforcement is positioned atop the first layer of polymer fibers. At block 206, a second layer of polymer fibers is formed atop the reinforcement so that the reinforcement is entirely covered and concealed by the first layer of polymer fibers and the second layer of polymer fibers. The fibers are typically randomly oriented and entangled together in the second layer. At block 208, a binder is applied to the first layer of polymer fibers, the reinforcement, and the second layer of polymer fibers. At block 210, the first layer of polymer fibers, the reinforcement, and the second layer of polymer fibers is heated to cure the binder to adhere the first layer of polymer fibers, the reinforcement, and the second layer of polymer fibers together.

In some embodiments, the reinforcement is non-centered within the polymeric material component so that the reinforcement is positioned closer to a top surface of the polymeric material component than a bottom surface of the polymeric material component. In such embodiments, the reinforcement may be positioned within the polymeric material component so that at least 60% of the polymeric material of the polymeric material component is positioned below the reinforcement and at least 5% of the polymeric material of the polymeric material component is positioned above the reinforcement.

The carrier mat may have a thickness between 1 and 8 millimeters and a weight of between 250 and 1,000 grams per square meter (gsm). The polymer fibers of the polymeric material component may be mechanically needled together to mechanically secure the polymeric material component and the reinforcement.

Figure 6:
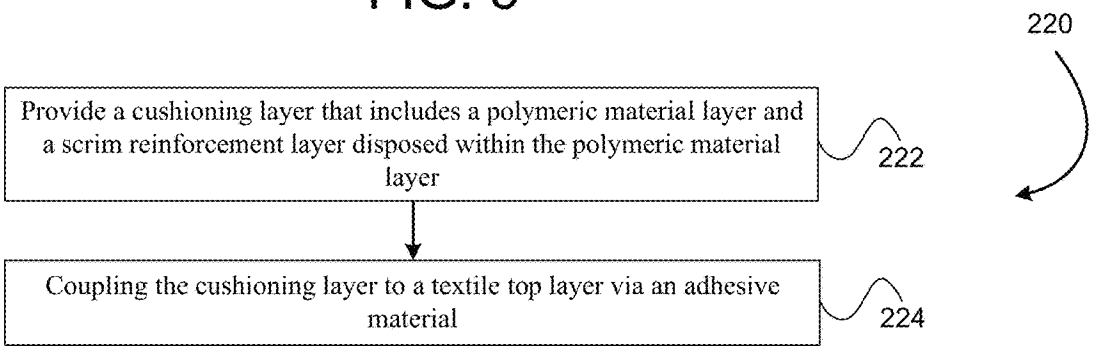
FIG. 6 illustrates a method of forming a carpet tile.

Referring now to FIG. 6, illustrated is a method 220 of forming a carpet tile. At block 222, the carrier mat that is formed via the method of FIG. 5 is provided. At block 224, the carrier mat is coupled to a textile top member via an adhesive material. The textile top member includes carpet yarns and a backing that is coupled with the carpet yarns. The adhesive material that couples the carrier mat and textile top member may penetrate into the entangled polymer fibers of the polymeric material component. In some embodiments, the adhesive material that penetrates into the entangled polymer fibers of the polymeric material component is a thermoplastic material or a plastisol. The polymer fibers of the polymeric material component may include or consist of polyesters, polyolefins, or a combination of polyesters and polyolefins.

Examples

A first example carrier mat was formed in accordance with the methods and embodiments described herein. The carrier mat included a reinforcement of glass threads that exhibited a maximum load of 16 lbf/in and a maximum elongation of 4% with threads in both directions to form a mesh or grid pattern. The mesh or grid included 4 threads per inch in the machine direction and 2 threads per inch in the cross-machine direction. The final weight of the carrier mat was 300 gsm. The carrier mat was composed of roughly 84% polyester fibers, 10% binder, and 6% reinforcement. The reinforcement was located with ⅓ of the polymer fibers above the reinforcement and ⅔ of the polymer fibers below the reinforcement.

A second example carrier mat was also formed. The carrier mat included a reinforcement of glass threads that exhibited a maximum load of 8 lbf/in and a maximum elongation of 7%. The reinforcement had glass threads in both directions to form a mesh or grid pattern with 5 threads per inch in the machine direction and 5 threads per inch in the cross-machine direction. The final weight of the carrier mat was 75 gsm. The carrier mat was composed of roughly 66% polymer fibers, 20% binder, and 14% reinforcement. The reinforcement was located in the center of the carrier mat thickness.

A third example carrier mat was also formed. The carrier mat included a reinforcement of glass threads that exhibited a maximum load of 6 lbf/in and a maximum elongation of 8%. The reinforcement included threads in only the machine direction with 3 threads per inch in the machine direction. The final weight of the carrier mat was 180 gsm. The carrier mat was composed of roughly 88% polymer fibers, 8% binder, and 4% reinforcement.

The Aachen dimensional stability for a carrier mat constructed according to the embodiments described herein was tested/measured according to the industry standard—i.e., ISO 2551. Below is a table of data that demonstrates the synergistic improvement when binder and scrim are used together in the carrier mat. In the table below, the "Aachen % change" values should be as close to zero as possible—i.e., zero means that the material did not shrink or grow during the week-long Aachen test. A negative "Aachen % change" represents shrinkage while a positive "Aachen % change" represents growth.

| | Aachen % change Machine Direction | Aachen % change Cross Machine Direction | % Improvement Machine Direction | % Improvement Cross Machine Direction |
|---|---|---|---|---|
| Polyester Mat | −0.275 | 0.067 | — | — |
| Scrim only | −0.208 | 0.079 | 24.4 | −17.9 |
| Binder only | −0.158 | 0.071 | 42.5 | −6.0 |
| Scrim + Binder | −0.05 | 0.008 | 81.8 | 88.1 |

As provided in the table above, adding a scrim to the polyester mat improved the Aachen somewhat in the machine direction (i.e., −0.208 is closer to zero than −0.275); however, the cross machine direction is slightly worse (i.e., 0.079 is further from zero vs. 0.067). This represents a 24.4% to Aachen in the machine direction when adding only scrim and a 17.9% worsening of Aachen in the cross machine direction. Adding a binder to the polyester mat resulted in an improvement to Aachen in the machine direction compared to scrim alone. However, the cross machine Aachen with only a binder added is slightly worse than the baseline.

Even though the addition of a scrim and binder both improved machine direction Aachen, when these materials are used in concert the improvement in machine direction Aachen is significantly greater than would have been anticipated (81.8% vs. 24.4% and 42.5%). In addition, the combination of a scrim and binder to the polyester mat significantly improved cross machine Aachen whereas the use of a scrim alone and a binder alone were both slightly worse than the baseline mat. The vast improvement in cross machine Aachen was not expected given that both materials used in isolation resulted in a decrease in cross machine Aachen.

Having described several embodiments, it will be recognized by those of skill in the art that various modifications, alternative constructions, and equivalents may be used without departing from the spirit of the invention. Additionally, a number of well-known processes and elements have not been described in order to avoid unnecessarily obscuring the present invention. Accordingly, the above description should not be taken as limiting the scope of the invention.

Where a range of values is provided, it is understood that each intervening value, to the tenth of the unit of the lower limit unless the context clearly dictates otherwise, between the upper and lower limits of that range is also specifically disclosed. Each smaller range between any stated value or intervening value in a stated range and any other stated or intervening value in that stated range is encompassed. The upper and lower limits of these smaller ranges may independently be included or excluded in the range, and each range where either, neither or both limits are included in the smaller ranges is also encompassed within the invention, subject to any specifically excluded limit in the stated range. Where the stated range includes one or both of the limits, ranges excluding either or both of those included limits are also included.

As used herein and in the appended claims, the singular forms "a", "an", and "the" include plural referents unless the context clearly dictates otherwise. Thus, for example, reference to "a process" includes a plurality of such processes and reference to "the device" includes reference to one or more devices and equivalents thereof known to those skilled in the art, and so forth.

Also, the words "comprise," "comprising," "include," "including," and "includes" when used in this specification and in the following claims are intended to specify the presence of stated features, integers, components, or steps, but they do not preclude the presence or addition of one or more other features, integers, components, steps, acts, or groups.

What is claimed is:

1. A carpet tile comprising:

a textile top member including:

carpet yarns; and a backing that is coupled with the carpet yarns so that the backing structurally supports the carpet yarns; and a carrier mat coupled with the textile top member via a thermoplastic material, the carrier mat comprising:

a polymeric material component comprising polymer fibers that are randomly oriented and entangled together;

a reinforcement that is disposed within the polymeric material component so that the reinforcement is entirely covered and concealed by the entangled polymer fibers to prevent the reinforcement from exposure to a user, the reinforcement including a plurality of continuous strand high tenacity fibers and being configured to mechanically reinforce and stabilize the polymeric material component and carpet tile; and a binder that is uniformly distributed throughout the polymeric material component and reinforcement component to bond the polymer fibers and continuous strand high tenacity fibers together in the carrier mat;

wherein the binder is the only binder that is used to bond the carrier mat together.

2. The carpet tile of claim 1, wherein the carrier mat has a thickness between 0.25 and 10 millimeters.

3. The carpet tile of claim 1, wherein the carrier mat has a weight of between 50 and 1,000 grams per square meter (gsm).

4. The carpet tile of claim 1, wherein the polymer fibers of the polymeric material component comprises polyesters, polyolefins, or a combination of polyesters and polyolefins.

5. The carpet tile of claim 1, wherein the reinforcement is a grid-pattern scrim made of high tenacity glass or polymer fibers that are oriented in a machine direction and a cross-machine direction.

6. The carpet tile of claim 1, wherein the carrier mat includes between 5 and 30 weight percent of the binder.

7. The carpet tile of claim 1, wherein the reinforcement is non-centered within the polymeric material component so that the reinforcement is positioned closer to an upper surface of the polymeric material component than a lower surface of the polymeric material component.

8. The carpet tile of claim 7, wherein the reinforcement is positioned within the polymeric material component so that at least 60% of the polymeric material of the polymeric material component is positioned below the reinforcement and at least 5% of the polymeric material of the polymeric material component is positioned above the reinforcement.

9. The carpet tile of claim 1, wherein the reinforcement is between 0.5 and 50 weight percent of the carrier mat.

10. The carpet tile of claim 1, wherein the continuous strand high tenacity fibers exhibit a maximum load of at least 6 lbf/in and a maximum elongation of 15% when measured according to ASTM D4830.

11. The carpet tile of claim 1, wherein the binder is a formaldehyde free binder.

12. The carpet tile of claim 11, wherein the formaldehyde free binder is a thermoplastic material binder.

13. The carpet tile of claim 12, wherein the continuous strand high tenacity fibers consist of polymer fibers such that the carrier mat is made entirely or recyclable materials.

14. The carpet tile of claim 1, wherein the polymer fibers are mechanically needled together to mechanically secure the polymeric material component and the reinforcement together.

15. The carpet tile of claim 1, wherein the thermoplastic material penetrates through the polymeric material component to couple the carrier mat with the textile top member.

16. A carpet tile comprising:

a textile top member including:

carpet yarns; and a backing that is coupled with the carpet yarns so that the backing structurally supports the carpet yarns; and a carrier mat coupled with the textile top member via a thermoplastic material, the carrier mat comprising:

a polymeric material component comprising a first layer of polymer fibers that are randomly oriented and entangled together and a second layer of polymer fibers that are randomly oriented and entangled together;

a reinforcement that is disposed between the first layer of polymer fibers and the second layer of polymer fibers so that the reinforcement is entirely covered and concealed by the polymeric material component to prevent the reinforcement from exposure to a user, the reinforcement being configured to mechanically reinforce and stabilize the polymeric material component and carpet tile; and a binder that is uniformly distributed throughout the polymeric material component and reinforcement component.

17. The carpet tile of claim 16, wherein the reinforcement is a scrim, threads, nonwoven mat, or chopped strand mat.

18. The carpet tile of claim 16, wherein the reinforcement consists of continuous strand high tenacity fibers.

19. The carpet tile of claim 16, wherein the binder is a formaldehyde free binder.

20. The carpet tile of claim 19, wherein the formaldehyde free binder consists of a thermoplastic material.

21. The carpet tile of claim 16, wherein the carrier mat has a thickness between 1 and 8 millimeters.

22. The carpet tile of claim 16, wherein the carrier mat has a weight of between 250 and 1,000 grams per square meter (gsm).

* * * * *